United States Patent [19]

Wilkins

[11] Patent Number: 5,027,945

[45] Date of Patent: Jul. 2, 1991

[54] MERCHANDISE SUPPORT ASSEMBLY AND HOOK SUITABLE FOR USE THEREWITH

[76] Inventor: Andre P. Wilkins, Private Road Number Eight, Colwick Industrial Estate, Nottingham, England

[21] Appl. No.: 469,519

[22] PCT Filed: Jul. 11, 1989

[86] PCT No.: PCT/GB89/00708

§ 371 Date: May 11, 1990

§ 102(e) Date: May 11, 1990

[87] PCT Pub. No.: WO90/00505

PCT Pub. Date: Jan. 25, 1990

[51] Int. Cl.[5] ..... B65D 85/18; A41D 27/22

[52] U.S. Cl. ..... 206/278; 206/292; 206/296; 223/85; 223/87; 223/DIG. 4

[58] Field of Search ..... 223/DIG. 4, 85, 87, 223/88; 206/278, 279, 300, 292, 293, 296

[56] References Cited

U.S. PATENT DOCUMENTS

| | | | |
|---|---|---|---|
| 2,751,071 | 6/1956 | Goldband | 206/45.31 |
| 3,037,621 | 6/1962 | Jackman | 206/294 |
| 4,601,417 | 7/1986 | Kunreuther | 223/85 |

FOREIGN PATENT DOCUMENTS

| | | |
|---|---|---|
| 052596 | 5/1982 | European Pat. Off. . |
| 2162886 | 2/1986 | United Kingdom . |

*Primary Examiner*—William I. Price

*Attorney, Agent, or Firm*—Jones, Askew & Lunsford

[57] ABSTRACT

A merchandise support assembly, for example for socks comprises a blank 10 having first, second, third fourth and fifth portions 12, 14, 16, 18, 26 folded at crease lines 20, 22, 24, 28 between the portions. A second portion 14 is folded at the crease line 20 so that it overlies part of the first portion 12 to which it is secured by adhesive. Folding at crease lines 20, 22 forms a pocket between the second and fourth portions 14, 18 which are spaced part by the width of the third portion 16. A hook 40 comprises a hook member 42 and flexible resilient support arms 46 inserted through an opening 38 adjacent a fourth crease line 28 at the junction of the first and fifth portions 12, 26. The arms 46 engage the sheet material along crease line 28 to support the folded blank 10. The support assembly is simple to make and the hook can readily be assembled with the folded blank 10.

23 Claims, 3 Drawing Sheets

MERCHANDISE SUPPORT ASSEMBLY AND HOOK SUITABLE FOR USE THEREWITH

This invention is concerned with a merchandise support assembly and hook suitable for use therewith.

Merchandise support assemblies have been proposed which comprise a sheet of material by which the merchandise may be supported and a hook connected with the sheet of material. Such assemblies are used to support merchandise, for example socks and other articles of clothing, the hook being carried by a support rail so that the merchandise is displayed for sale; the assembly carrying the merchandise can readily be lifted from the support rail when a sale occurs. One such merchandise support assembly is described in UK Patent Specification No. 2162886 in which the assembly comprises a connection member to which merchandise are secured by any suitable means and a sheet of flexible plastics material folded along a centre line and having an aperture through which a hook member is inserted, the hook member upstanding from a pair of shoulders members on which the sheet material is located so that it rests on the shoulder members. The hook is positioned by passing the hook member through the opening and, whilst this type of assembly has been found to be reasonably satisfactory, there is a tendency for the sheet material to be ripped as the hook member is passed through the opening. Furthermore, the configuration of the sheet material is not particularly satisfactory in that the merchandise is received between two leaves of the sheet material. This tends to force them apart which may allow the hook member to slip out of the hole, especially if the material around the hole has been damaged during introduction of the hook member.

One of the various objects of the present invention is to provide an improved merchandise support assembly.

In one aspect the invention may be considered to provide a merchandise support assembly including a carrier member comprising foldable sheet material comprising a first, support portion, a second portion meeting the first portion at a first crease line folded so that it overlies the first portion at least partially but, preferably, does not project beyond the first portion and is secured to the first portion, a third portion meeting the second portion at a second crease line, and a fourth portion meeting the third portion at a third crease line parallel with the second crease line, the sheet material being folded about the second and third crease lines so that the second portion is in register with part at least of the fourth portion but spaced from it by the third portion to provide a merchandise-received pocket between the second and fourth portions.

Preferably in a support assembly in accordance with the invention contiguous first edges defining one boundary of the first and second portions meet at the first crease line and lie adjacent one another. The first crease line is inclined at an oblique angle to said first edges. A second edge of the first portion defining an opposite boundary of the first portion comprises a first edge portion parallel with said first edge of the first portion and a second portion angled towards the first edge of the first portion and lying adjacent a second edge of the second portion defining an opposite boundary of the second portion and the second edge portion and second edge of the second portion are co-linear, of equal lengths and both perpendicular to the first crease line.

In a preferred support assembly in accordance with the invention the first second and third crease lines are parallel; preferably opposite first and second edges of the third portion are also parallel and of equal lengths.

Preferably in a support assembly in accordance with the invention opposite first and second edges of the fourth portion are parallel with one another and, when said third portion is perpendicular to both the second and fourth portions, the first edge of the fourth portion is in register with the first edges of the first and second portions; the first edges of the first, second and fourth portion are thus in alignment viewed in a direction perpendicular to the plane of the fourth portion.

A preferred support assembly in accordance with the invention further comprises a fifth portion which meets the first portion at a fourth crease line extending between the first and second edges of the first portion, preferably perpendicular to the first and second edges adjacent the fourth crease line, of the first and fifth portions; the sheet material is folded so that the fifth portion overlies part, at least of the first portion at the opposite side to the second portion. The support assembly preferably comprises an opening in the region of this fourth crease line, suitably formed in the fifth portion adjacent the crease line. Preferably edges of the first and fifth portion remote from the third and fourth crease lines respectively are parallel with the fourth crease line.

In another aspect the invention may be considered to provide a hook suitable for use in a merchandise support assembly comprising a carrier member by which merchandise may be carried, the carrier member having an opening, the hook comprising a hook member extending from a connection portion generally in the direction of a first axis, support arms projecting outwardly from the connection portion of the hook member generally along a second axis perpendicular to the first axis, the arms being relatively rigid in the general direction of the first axis and resiliently flexible in the general direction of a third axis perpendicular to both the first and second axes the arms being adapted to be flexed in the region of their junction with the connection portion until they lie side by side projecting generally in the direction of said third axis with the spacing therebetween sufficient to permit insertion through the opening in a carrier member.

Preferably the connection portion of a hook in accordance with the invention has a width considered in the direction of the second axis less than the width of a body portion of the hook member immediately adjacent the connection portion whereby to provide a notch for reception of sheet material between the body portion and the support arms.

Preferably a hook in accordance with the invention is substantially planar in a plane defined by the first and second axes.

Preferably in a hook in accordance with the invention each arm projects from the connection portion along the second axis a distance of at least half of but not exceeding the overall length of the hook along the first axis.

Preferably in a hook in accordance with the invention the width of each arm considered in the direction of the first axis is between 15% and 33% of its length.

Preferably in a hook in accordance with the invention the thickness of each arm considered in the direction of the third axis is between 10% and 30% of its width.

In a preferred hook in accordance with the invention the surfaces of the body portion and connection portion of the hook member and of the support arms on one side of the hook are generally co-planar and, on the opposite side of the hook, the surfaces of the arms and body portion are generally co-planar but the body portion meets the connection portion at a shoulder projecting beyond the plane of the connection portion. The height of the shoulder is preferably about the thickness of sheet material of a support assembly with which the hook is intended to be used.

A preferred support assembly in accordance with the invention comprises a hook in accordance with the invention in which the hook member projects through the opening in the sheet material and the support arms of the hook engage the sheet material along the fourth crease line. In a preferred assembly the length of the opening transversely of the blank (in a direction lengthwise of the fourth crease line) is slightly greater than the width of the connection portion of the hook and its depth transversely to the fourth crease line is slightly more than the width of the support arms of the hook.

In another aspect the invention may be considered to provide a blank suitable for use in forming a carrier member of a merchandise support assembly in accordance with the invention.

A preferred blank comprises first and second opposite edges and first, second and third parallel crease lines extending from the first to the second edges the first edge being inclined at either side of the first crease line so that the crease line bisects the angle between the adjacent portions of the first edge, and the first crease line meeting the second edge perpendicularly thereto, the first crease line separating first and second portions of the blank having boundaries defined in part by the first and second edges wherein the first edge of the first portion is parallel with a first edge portion of the second edge of the first portion and wherein the second edge of the second portion is co-linear with and the same length as a second edge portion of the first portion.

In a preferred blank in accordance with the invention the second portion and a third portion of the blank meet at the second crease line and the second edges of the second and third portions are co-linear.

There now follows a detailed description to be read with reference to the accompanying drawings of a merchandise support assembly, a blank suitable for use in forming the assembly and a hook for use in the assembly, embodying the invention. It will be realised that this assembly, blank and hook have been selected for description to illustrate the invention by way of example.

In the accompanying drawings

Figure 1:
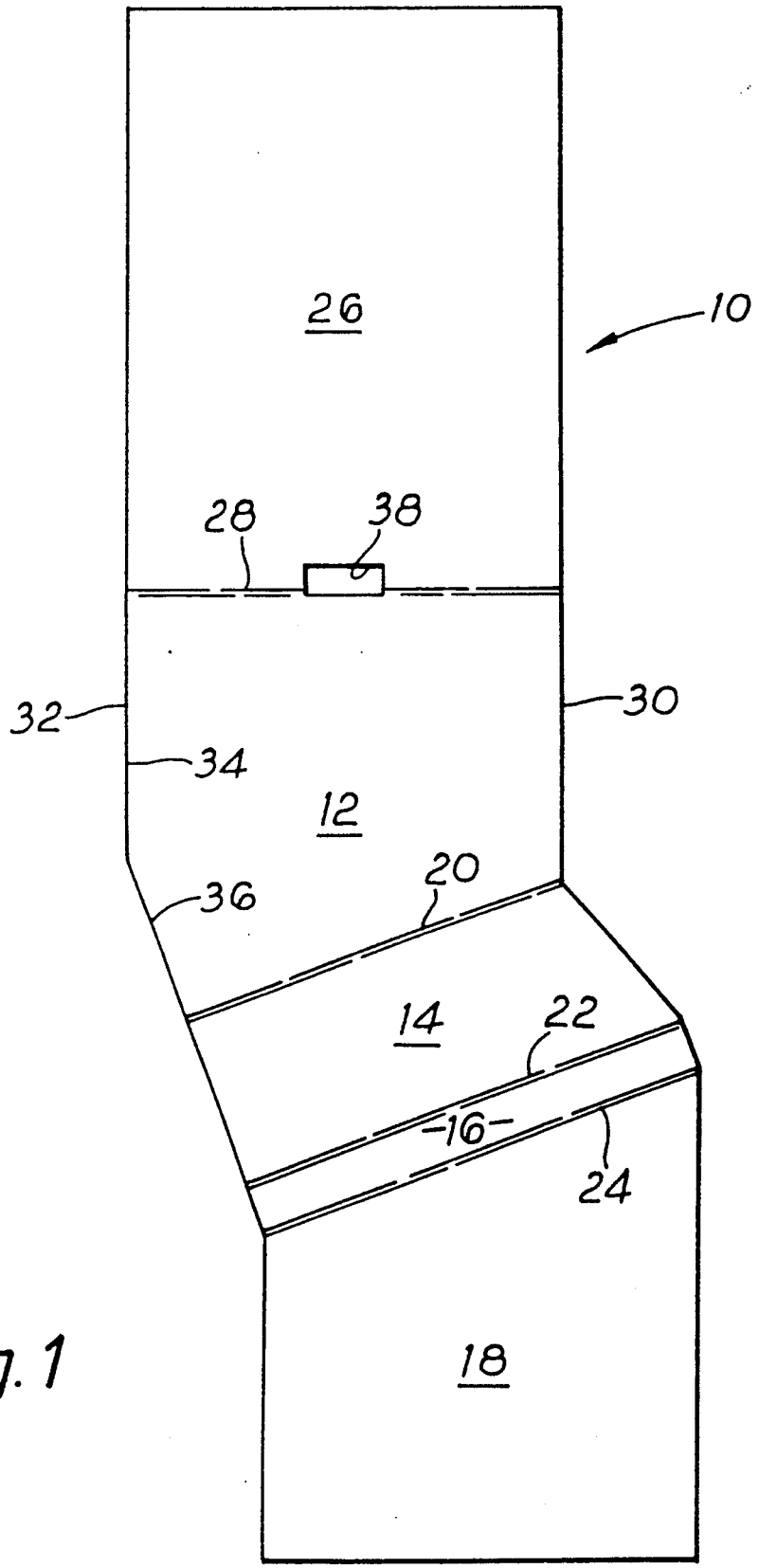
FIG. 1 is a plan view of a blank embodying the invention.

The illustrative blank 10 is formed of any suitable sheet material which is relatively stiff but foldable, for example card or plastics material.

A preferred blank 10 is formed by cutting the blank from a sheet of suitable card.

The blank 10 comprises a first portion 12, a second portion 14, a third portion 16 and a fourth portion 18; the first and second portions meet at a first crease line 20, the second and third portions at a second crease line 22 and the third and fourth portions at a third crease line 24; the first, second and third crease lines 20, 22, 24 are parallel. The blank further comprises a fifth portion 26 which meets the first portion 12 at a fourth crease line 28 spaced from the first crease line 20. The crease lines 20, 22, 24, 28 extend between first and second edges 30, 32 of the blank. The first edges 30 defining the boundaries of the first and second portions 12, 14 meet at the crease line 20 at an angle which is bisected by the crease line 20. The second edge 32 defining the boundary of the first portion 12 comprises two portions, 34, 36 which meet at an oblique angle, the edge portion 36 being inclined inwardly towards the first edge 30 and being co-linear with the second edge 32 defining the boundary of the second portion 14. The second edge of the portion 14 is equal in length with the second edge portion 36 of the first portion 12.

The second edge 32 of the second portion 14 is also co-linear with the second edge defining the boundary of the third portion 16 and parallel with the first edge 30 defining the boundary of the third portion 16.

The first and second edges 30, 32 bounding the fourth portion 18 are parallel with one another and with the first and second edges 30, 32 bounding the fifth portion 26 and the first portion 12.

Preferably the illustrative blank 10 is pre-creased at the crease lines 20, 22, 24, 28 so that it can be readily folded along these lines.

The blank further comprises a rectangular opening 38 formed in the fifth portion 26 adjacent the crease line 28, with one edge of the opening 38 lying along the crease line 28.

The illustrative hook 40 (see especially FIGS. 2 and 6) is moulded of a suitable stiff flexible plastics material and is of generally of planar configuration. The hook 40 comprises a hook member 42 extending from a connection portion 44 generally in the direction of a first axis, support arms 46 projecting outwardly from the connection portion 44 of the hook member 42 generally along a second axis perpendicular to the first axis. The arms 46 are relatively rigid in the general direction of the first axis but resiliently flexible in the general direction of a third axis perpendicular to both the first and second axes. Thus, the arms 46 may be flexed in the region of their junction with the connection portion 44 in the directions indicated by the arrows in FIG. 2. The arms 46 may be flexed until they lie side by side (generally parallel as indicated in chain dot line in FIG. 2) projecting generally in the direction of the third axis for insertion through the opening 38 in a folded blank 10. As can be seen viewing FIG. 2, the connection portion 44 has a width considered in the direction of the second axis less than the width of a body portion 48 of the hook member 42 immediately adjacent the connection portion 44 whereby to provide notches 50 for reception of sheet material between the body portion 48 and the support arms 46. The width of the connection portion 44 is slightly less than the length of the opening 38 considered transversely of the blank 10 such that when the support arms 46 are bent to the position shown in chain-dot line in FIG. 2, the arms will pass through the opening 38 without fouling the opposite ends. The width of each arm 46 is slightly less than the width of the opening (considered lengthwise of the blank 10).

Each arm of the illustrative hook projects from the connection portion along the second axis a distance of at least half of but not exceeding the overall length of the hook 40 along the first axis, preferably about ⅔ of the overall length of the hook. Preferably the width of each arm 46 considered in the direction of the first axis is between 15% and 33% of its length, more preferably about 22% of its length. The thickness of each arm considered in the direction of the third axis is preferably between 10% and 30% suitably about 20% of its width. One preferred hook has an overall length along the first axis of about 3.5 cm.

Figure 6:
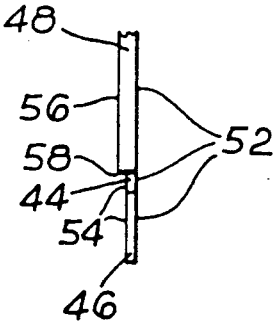
FIG. 6 is a fragmentary view of part of the illustrative hook.

As can been seen from FIG. 6 the surfaces 52 of the body portion 48, connection portion 44 and support arms 46 on one side of the hook are generally co-planar On the opposite side of the hook the surfaces 54 of the connection portion 44 and arms 46 are generally co-planar but the body portion 48 meets the connection portion 44 at a shoulder 58 projecting beyond the plane 54 of the connection portion 44, the height of the shoulder 58 being about the thickness of the sheet material of the blank 10 e.g. about 1 mm. The surface 56 of the body portion 48 thus being spaced further from the surface 52 than the surfaces 54 of the connection portion 44 and arms 46.

In the manufacture of the illustrative support assembly after the blank 10 has been cut and creased, it is folded along the crease lines. The second portion 14 is folded relative to the first portion 12 about the crease line 20 so that it overlies the first portion 12 but not project beyond the first portion and is secured to the first portion 12 by means of a suitable adhesive; any suitable adhesive may be used.

Figure 2:
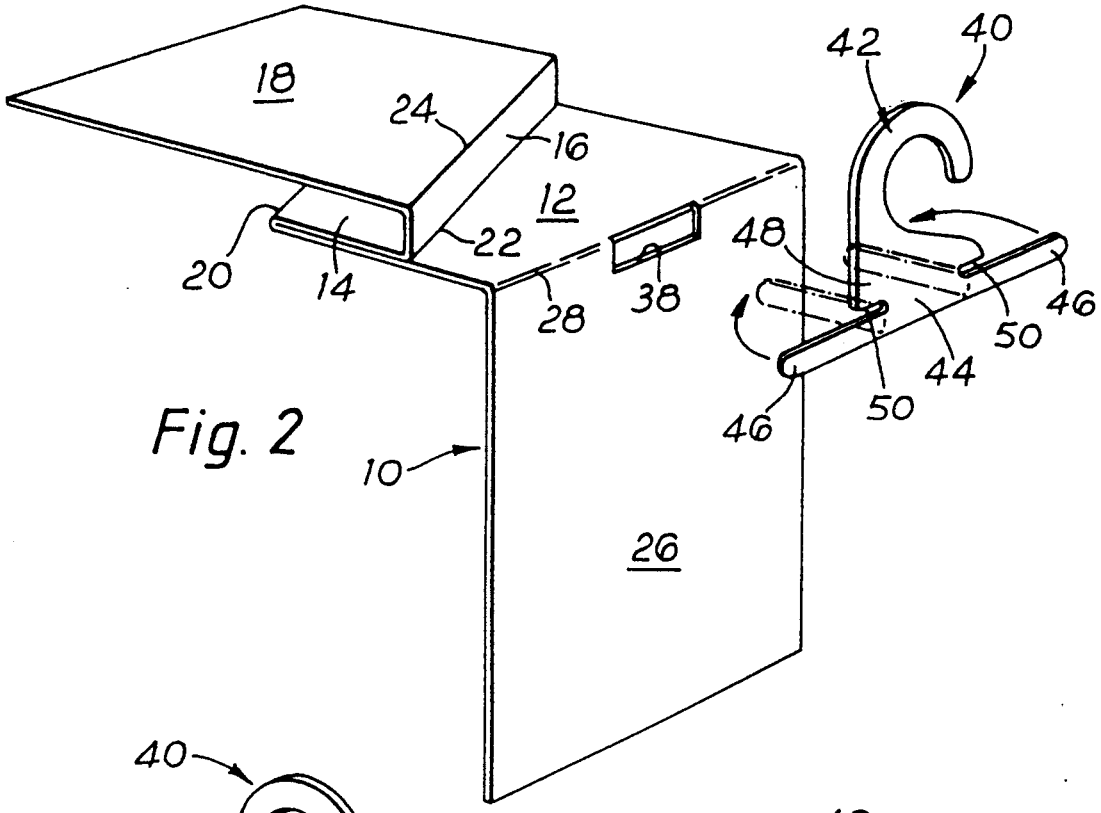
FIG. 2 is a view of a blank partially folded during the manufacture of the assembly, showing the connection of a hook embodying the invention to the partially folded blank.
Figure 3:
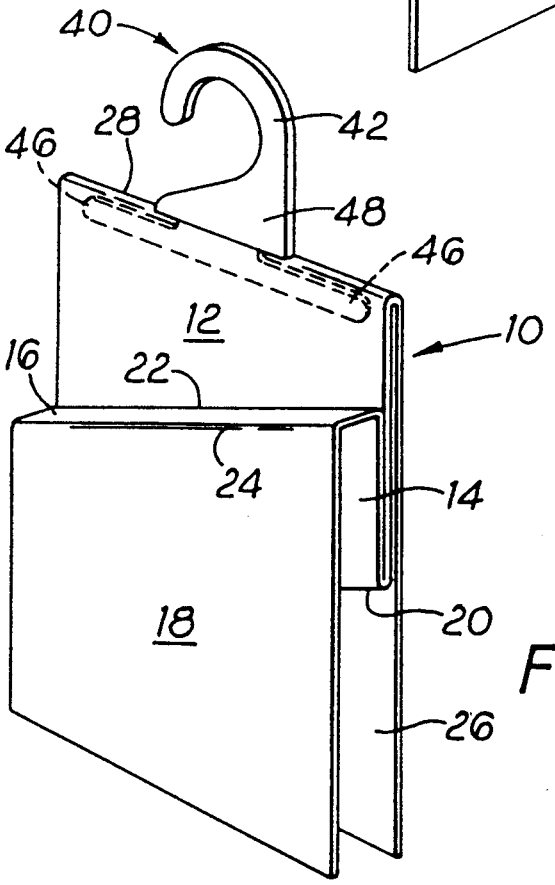
FIG. 3 is a perspective view of a merchandise support assembly embodying the invention.

The third portion 16 is then bent at the crease line 22 relative to the second portion 14 and the fourth portion 18 folded at the crease line 24 relative to the third portion 16 so that they adopt the positions in which they are shown in FIG. 2. The fifth portion 26 is then folded at the crease line 28 relative to the first portion 12 so that it occupies the position in which it is shown in the FIG. 2. The hook 40 is then manipulated so that the support arms 46 adopt their substantially parallel chain-dot position of FIG. 2 and they are inserted through the opening 38 from the position shown in FIG. 2. As the support arms 46 are resilient, once they have been inserted they spring open to the full line position of FIG. 2. The hook 40 is inserted so that the shoulder 58 overlies the edge of the opening 38 which lies on the crease line 28. As can be seen from FIG. 2 the upper edges of the arms 46 adjacent the notches 50 are co-linear and support the assembly along the fourth crease line 28.

The folding of the sheet material to the position in which it is shown in FIG. 2 creates a merchandise support assembly in which the second portion 14 and part of the fifth portion 26 are in register with the fourth portion 18 but spaced from it by the width of the third portion 16, thus providing a merchandise-receiving pocket between the fourth portion 18 and the second and fifth portions 14 and 26. Merchandise, for example a pair of socks 60, appropriately folded (see FIGS. 4 and 5) are introduced into this pocket and secured in place by a suitable fastener member which is conveniently arranged to pass through the fourth, second, first and fifth portions 18, 14, 12, and 26. One suitable fastener member comprising a plastics tag 62 having T-pieces 64 at each end which can be bent relative to a shank portion 66 and inserted through appropriate holes in the portions 18, 14, 12, 26, passing through the folded layers of the merchandise for example the socks 60.

Figure 4:
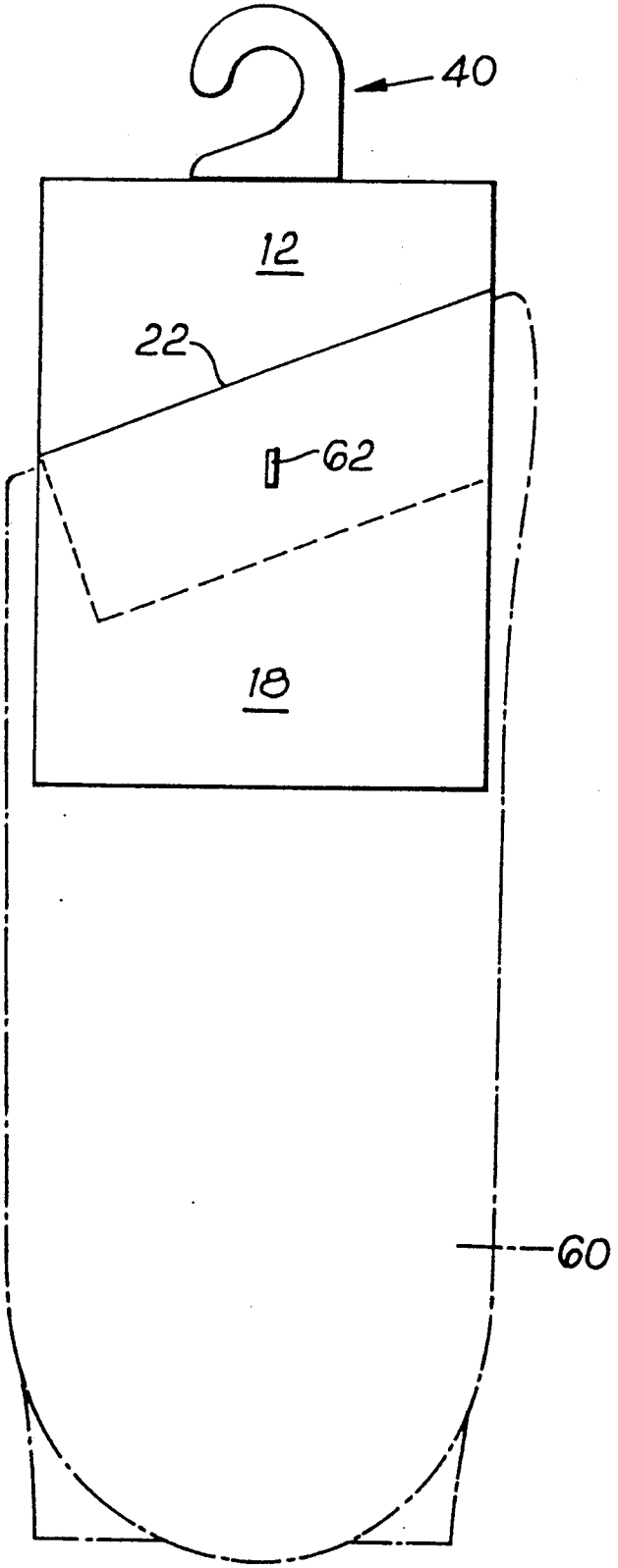
FIG. 4 is a front view of the illustrative merchandise support assembly.
Figure 5:
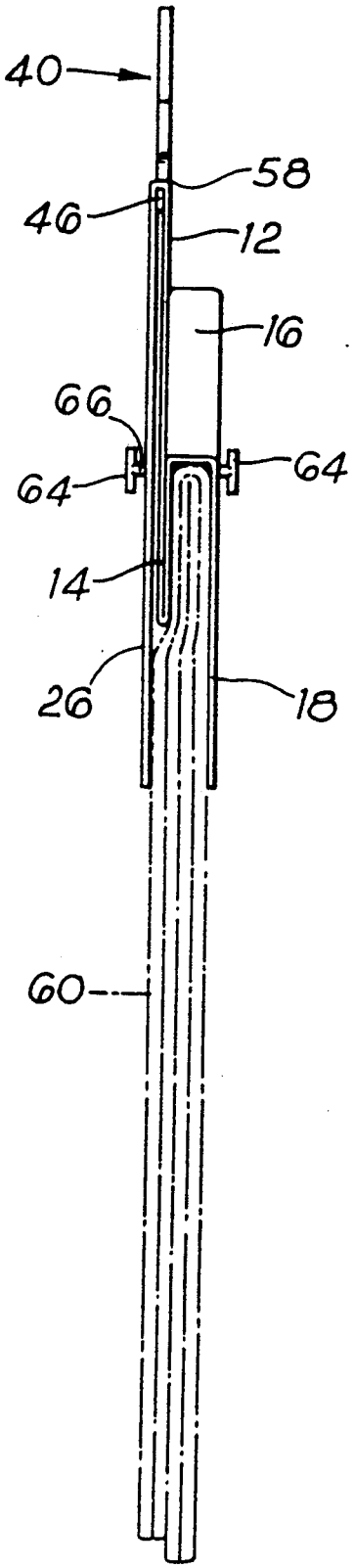
FIG. 5 is a side view of the illustrative merchandise support assembly.

As can be seen viewing the drawings, especially FIGS. 4 and 5, socks 60 may be attractively packaged by the illustrative merchandise support member. Because the merchandise is received in the pocket between the fourth portion 18 and the second portion 14, the weight of the merchandise tends to urge the first portion 12 towards the fifth portion 16 when the assembly is supported by the hook thus keeping the assembly well folded at the fold line 28. This minimises any tendency for the support arms 46 to flex or twist when the assembly is suspended from the hook 40, ensuring that the support arms 46 remain in their desired position. The sheet material of the blank 10 is received in the notches 50 to retain the hook 40 in position and the shoulder 58 abuts the first portion 12 along the edge of the opening 38 at the crease line 28.

The blank 10 may be printed, preferably before it is cut-out, if desired, for example with a suitable trade mark and promotional matter.

The illustrative merchandise support assembly is simple to manufacture and the hook 40 can readily be inserted into position with little or no risk of tearing the sheet material around the opening 38.

I claim:

1. A merchandise support assembly including a carrier member comprising foldable sheet material comprising a first, support portion, a second portion meeting the first portion at a first crease line folded so that it overlies the first portion at least partially and is secured to the first portion, a third portion meeting the second portion at a second crease line, and a fourth portion meeting the third portion at a third crease line parallel with the second crease line, the sheet material being folded about the second and third crease lines so that the second portion is in register with part at least of the fourth portion but spaced from it by the third portion to provide a merchandise-receiving pocket between the second and fourth portions.

2. A support assembly according to claim 1 wherein contiguous first edges defining one boundary of the first and second portions meet at the first crease line and lie adjacent one another, wherein the first crease line is inclined at an oblique angle to said first edges, wherein a second edge of the first portion defining an opposite boundary of the first portion comprises a first edge portion parallel with said first edge of the first portion and a second edge portion angled towards the first edge of the first portion and lying adjacent a second edge of the second portion defining an opposite boundary of the second portion, and wherein said second edge portion and said second edge of the second portion are of equal lengths and both perpendicular to said first crease line.

3. A support assembly according to either one of claims 1 and 2 wherein said first, second and third crease lines are parallel.

4. A support assembly according to claim 3 wherein opposite first and second edges of said third portion are parallel and of equal lengths.

5. A support assembly according to claim 1 wherein opposite first and second edges of the fourth portion are parallel with one another and, when said third portion is perpendicular to both the second and fourth portions, wherein said first edge of the fourth portion is in register with said first edges of the first and second portions.

6. A support assembly according to claim 1 comprising a fifth portion meeting the first portion at a fourth crease line extending between the first and second edges of the first portion, the sheet material being folded so that the fifth portion overlies part, at least, of the first portion at the opposite side to the second portion.

7. A support assembly according to claim 6 comprising an opening in the region of the fourth crease line.

8. A support assembly according to claim 7 wherein the opening is formed in the fifth portion adjacent the crease line.

9. A support assembly according to claim 6 wherein the fourth crease line is perpendicular to the first and second edges adjacent the fourth crease line of the first and fifth portions.

10. A support assembly according to claim 9 wherein edges of the first and fifth portions remote from the third and fourth crease lines respectively are parallel with the fourth crease line.

11. A blank suitable for use in forming a merchandise support assembly according to claim 1 the blank having first and second opposite edges and first second and third parallel crease lines extending from the first to the second edges, the first edge being inclined at either side of the first crease line so that the crease line bisects the angle between the adjacent portions of the first edge, and the first crease line meeting the second edge perpendicularly thereto, the first crease line separating first and second portions of the blank having boundaries defined in part by the first and second edges wherein the first edge of the first portion is parallel with a first edge portion of the second edge of the first portion and wherein the second edge of the second portion is co-linear with and the same length as a second edge portion of the first portion.

12. A blank according to claim 11 wherein the second portion and a third portion of the blank meet at the second crease line and wherein the second edges of the second and third portions are co-linear.

13. A merchandise support assembly comprising a carrier member by which merchandise may be carried and a hook attached to the carrier member, the hook comprising a hook member extending from a connection portion generally in the direction of a first axis, support arms projecting outwardly from the connection portion of the hook member generally along a second axis perpendicular to the first axis, the carrier member including a fold extending in the second axis direction along which the arms underlie and an opening adjacent to the fold, the opening having a length in the second axis direction greater than the width of the connection portion along the second axis direction and having a width in the first axis direction greater than the width of the arms in the first axis direction, and the arms being relatively rigid in the general direction of the first axis and resiliently flexible in the general direction of a third axis perpendicular to both the first and second axes whereby the arms may be flexed in the region of their junction with the connection portion until they lie side by side projecting generally in the direction of said third axis for insertion through the opening in the carrier member.

14. An assembly according to claim 13, wherein the carrier member is formed from sheet material, and the connection portion has a width considered in the direction of the second axis less than the width of a body portion of the hook member immediately adjacent the connection portion whereby to provide a notch for reception of sheet material between the body portion and the support arms.

15. An assembly according to claim 13, wherein the hook is substantially planar in a plane defined by the first and second axes.

16. An assembly according to claim 13, wherein each arm projects from the connection portion along the second axis a distance of at least half of but not exceeding the overall length of the hook along the first axis.

17. An assembly according to claim 13, wherein the width of each arm considered in the direction of the first axis is between 15% and 33% of its length.

18. An assembly according to claim 17, wherein the thickness of each arm considered in the direction of the third axis is between 10% and 30% of its width.

19. An assembly according to claim 15, wherein the surfaces of the body portion and connection portion of the hook member and of the support arms on one side of the hook are generally co-planar, and wherein on the opposite side of the hook the surfaces of the arms and body portion are generally co-planar but the body portion meets the connection portion at a shoulder projecting beyond the plane of the connection portion.

20. An assembly according to claim 19, wherein the height of the shoulder is about the thickness of the sheet material of the carrier member.

21. An assembly according to claim 13, wherein an edge of the opening is aligned with the fold.

22. An assembly according to claim 13, wherein the carrier member comprises foldable sheet material comprising a first support portion, a second portion meeting the first portion at a first crease line folded so that it overlies the first portion at least partially and is secured to the first portion, a third portion meeting the second portion at a second crease line, and a fourth portion meeting the third portion at a third crease line parallel with the second crease line, the sheet material being folded about the second and third crease lines so that the second portion is in register with part at least of the fourth portion but spaced from it by the third portion to provide a merchandise-receiving pocket between the second and fourth portions.

23. A process of producing a merchandise support assembly comprising a carrier member by which merchandise may be carried and a hook attached to the carrier member, the hook comprising a hook member extending from a connection portion generally in the direction of a first axis, support arms projecting outwardly from the connection portion of the hook member generally along a second axis perpendicular to the first axis, the carrier member including a fold extending in the second axis direction along which the arms underlie in the assembled assembly, and an opening adjacent to the fold, the opening having a length in the second axis direction greater than the width of the connection portion along the second axis direction and having a width in the first axis direction greater than the width of the arms in the first axis direction, the arms being relatively rigid in the general direction of the first axis and resiliently flexible in the general direction of a third axis perpendicular to both the first and second axes, the process including the steps of flexing the arms until they lie side by side projecting generally in the direction of said third axis, inserting the side by side arms through the opening in the third axis direction, and releasing the arms to permit them to return to extend along the second axis and underlie said fold.

* * * * *